US006595584B1

(12) United States Patent
Caldwell

(10) Patent No.: US 6,595,584 B1
(45) Date of Patent: Jul. 22, 2003

(54) SEATING FOR INDIVIDUALS AND FOR GROUPS OF INDIVIDUALS WITH VARIOUS DEGREES OF ACCOMMODATION AND DISTRACTION

(76) Inventor: John W. Caldwell, 1829 Warwick Rd., San Marino, CA (US) 91108

( * ) Notice: Subject to any disclaimer, the term of this patent is extended or adjusted under 35 U.S.C. 154(b) by 0 days.

(21) Appl. No.: 10/051,974

(22) Filed: Jan. 16, 2002

(51) Int. Cl.[7] ..... A47C 1/024; A47C 1/02; A47C 3/02

(52) U.S. Cl. ..... 297/258.1; 297/302.1; 297/302.3; 297/325

(58) Field of Search ..... 297/302.1, 302.3, 297/325, 326, 258.1; 248/129

(56) References Cited

U.S. PATENT DOCUMENTS

| | | | | | |
|---|---|---|---|---|---|
| 1,722,543 | A | * | 7/1929 | Selje | 297/302.6 |
| 3,025,058 | A | * | 3/1962 | Brumfield | 473/483 |
| 4,889,384 | A | * | 12/1989 | Sulzer | 297/303.4 |
| 4,911,501 | A | * | 3/1990 | Decker et al. | 297/300.8 |
| 5,288,138 | A | * | 2/1994 | Stulik et al. | 297/302.1 |
| 5,664,835 | A | * | 9/1997 | Desanta | 297/302.1 |
| 5,967,609 | A | * | 10/1999 | Potter | 297/325 |
| 2002/0005658 | A1 | * | 1/2002 | Piretti | 297/302.3 |

FOREIGN PATENT DOCUMENTS

| | | | | | |
|---|---|---|---|---|---|
| DE | 3800751 | A1 | * | 8/1988 | A47C/1/032 |
| EP | 130229 | A1 | * | 1/1985 | A47C/3/12 |

* cited by examiner

*Primary Examiner*—Peter M. Cuomo
*Assistant Examiner*—Sarah C. Burnham
(74) *Attorney, Agent, or Firm*—Donald D. Mon

(57) ABSTRACT

Seating such as chairs and groups of chairs which include a base, a support for an occupant, and a control mounting the support to the base which optionally can enable a rocking motion for the support, and a control for this purpose. A plurality of seating elements and other furniture items can be supported on a single beam.

4 Claims, 6 Drawing Sheets

SEATING FOR INDIVIDUALS AND FOR GROUPS OF INDIVIDUALS WITH VARIOUS DEGREES OF ACCOMMODATION AND DISTRACTION

FIELD OF THE INVENTION

Seating, such as chairs and groups of chairs and tables that provide to individuals selectable degrees of accommodation and distraction.

BACKGROUND OF THE INVENTION

Persons seated in public seating are frequently impatient and distracted. The realities of the situation are often such that a wait may seem longer and be less pleasant than it really is, or should be. It is an objective of a sympathetic supplier of public seating to make the situation as comfortable, and as pleasant as possible. However, as will be seen, there are limitations as to how far these efforts can go.

Especially in medical and surgical offices, the accommodation of waiting patients and their companions is a significant problem, requiring tolerance and empathy for the discomfort and attitude of ailing and impatient persons who are often impaired or otherwise suffering from worry and concern for themselves and for others dear to them, and who are impatient with delays. Beyond this compassionate concern is the sensible objective of providing them with safe and accessible seating structures which will support them without adding to their miseries, and from which they can rise without unnecessary additional discomfort.

As to their comfort, when they are seated, it is usually best for their feet to rest directly on the floor without constricting circulation of the blood to the legs. For patients with many of the most frequent ailments, it is also useful to provide seat motion that can be restful or distracting. A rocking motion is an example. However for other types of ailments, such as some heart problems, such motion should be avoided because of the possibility of a fright reaction when the person sits down on a chair which yields and rocks. Chairs according to this invention can prevent or allow the rocking motion.

Sanitation in all public seating, medical and otherwise, is a serious concern. Ease of cleaning, such as by steam cleaning and wash-down with astringent solutions are objectives which often cannot be met without severely damaging the seat, for example its upholstery. It is an object of this invention to provide seating structures which can comfortably support a person and which can be sanitized without disassembly or damage.

With all of these variables (and more) the doctor is faced with another problem. His waiting room is real estate which for economic reasons should be kept as small as possible and yet should be uncluttered, attractive, comfortable, and suitable to his clientele. This situation is shared by all providers of public seating, not merely doctors.

Persons who have endured long waits in these rooms will confirm that, while there have been efforts to alleviate at least some of the problems, it is rare to feel comfortably seated in a doctor's waiting room, in large part because the seating is so basically uncomfortable, and also because the room is so ordinary.

This situation is not confined to the medical and surgical fields. Airport waiting rooms and holding rooms in various institutions are other examples, for example unemployment offices. These environmental situations can profit from this invention, as well.

Some of the problems arise not only from the type of materials used for the furniture, but also in how they support the individual. Wooden benches with unyielding platforms or slats, with or without cushions are well-known for their discomfort. Similarly, suspended fabrics that droop, or cushions that do not support or are too hard, are too well-known.

Unyielding structures, and structures that rock but are not self-limiting, and which require steadiness of the occupant are not only uncomfortable, but often are risky and alarming to a patient who needs sensible restraint. For example, some coronary patients require firm stability, and some patients with balance disorders are distressed by a movable support.

It is an object of this invention to provide seating units with sensibly deflectable support that conforms to a limited extent to the user's shape, and which can, if desired, be adapted for limited rocking motion with minimal changes in the alignment of the user's seat, legs and back.

It is another object of this invention to provide a plurality of such devices whereby they can be arranged and assembled together in groups, all the while.being attractive as well as comfortable.

In addition, the rocking elements can preferably either be locked out or eliminated entirely for use in situations where the user would possibly be alarmed by movement of the structure. Heart disease patients constitute an example of such people.

The seat and its control are so disposed and arranged that in any tilted position, the seat allows the user to rest his or her feet on the floor, without localized compressive contact on the legs that would lead to discomfort, or which could make it more difficult to rise from the seat.

BRIEF DESCRIPTION OF THE INVENTION

A seat according to this invention includes a base, a control, and a support. The support is mounted to the base by the control. The control preferably provides for a knee action tilt movement that enables the support to engage in a rocking motion. Optionally, this movement may be disabled (or not provided at all) so that the support could be locked to the base in a selected alignment.

The base has two laterally spaced apart struts, with two legs each that contact the floor, with an intersection forwardly of the midpoint between their points of contact with the ground.

The support is intended comfortably to receive the seated person. It includes a bottom and a back. While both the bottom and the back may be made of rigid material, this invention enables the use of flexible material for both which is able to afford at least some conformation with the user.

The support is mounted to the base by a control supported by the base beneath the support. The control preferably is mounted between bridging cross arms extending between two sides of the support. The support is thereby mounted to and above the base with the capacity either to rock relative to the base, or to be locked or otherwise held in one position above the base. A second set of bridging cross arms extends between the struts.

According to a preferred but optional feature of the invention, the forward edge of the bottom is curled downwardly, with a radius which will allow an average person to sit on the bottom with his or her feet flat on the floor, comfortably and without restrictive compressive pressure on the bottom of the legs under the knee. Especially when the control permits rocking movement, the user can leave the seat while his or her feet are flat on the ground, and will-not tend to tumble or slip when the support tilts forwardly. This enables a safe and comfortable exit from the seat.

According to a preferred but optional feature of the invention, the control includes a reference pivot rigidly fixed relative to the base whose axis of rotation is located near the center of the radius of the lip of the bottom of the support, and by this arrangement is under the knee.

The support's center of gravity is behind the reference pivot, so that with or without the capacity to rock, the user's center of gravity will be behind the pivot point. When rocking motion is to be enabled, the control comprises a control arm fixed to the support and rotatably mounted to the base, a stiff flexure comprising a cantilever arm rigidly mounted to the base, and a contactor rigidly mounted to the support and in contact with the cantilever arm. The unloaded contact of the contactor and the cantilever arm biases the support toward its upright position.

According to a preferred but optional feature of the invention, rear struts of the base are provided at their ground-contacting ends with rollers and rigid pads. The pads are in contact with the floor when the seat is intended to be stationary. The rollers are mounted such that when the unloaded base is tilted, the rollers and not the pads contact the floor so the seat can readily be moved around.

According to still another preferred but optional feature of this invention, all of its parts are constructed of materials that will not be damaged by water, steam, or by conventional sanitizing solutions.

The above and other features of this invention will be fully understood from the following detailed description and the accompanying drawings, in which:

DETAILED DESCRIPTION OF THE INVENTION

Figure 2:
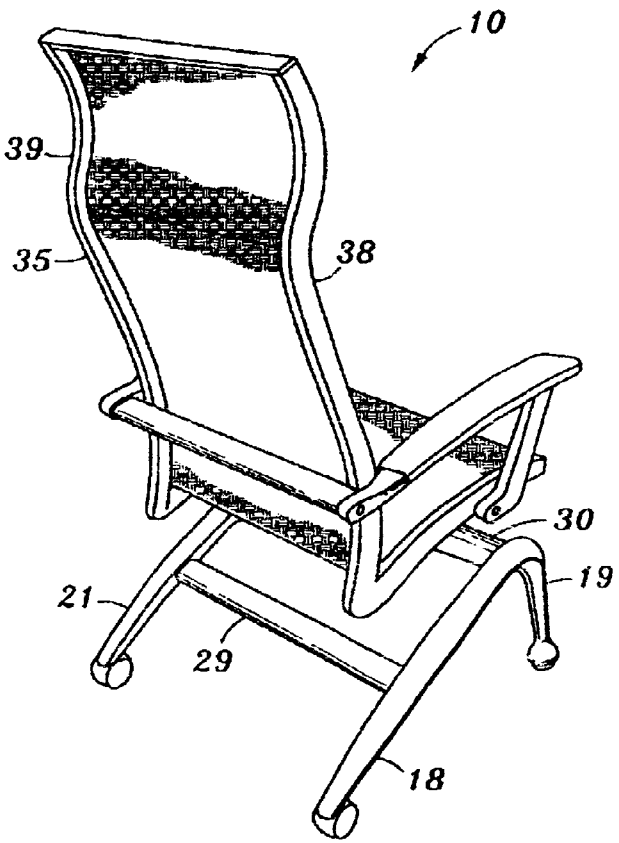
FIG. 2 is a perspective view from the right rear corner of the chair of FIG. 1.

A seat 10 according to this invention is intended to rest firmly on a floor 11, or if desired to be tilted and moved around the floor on rollers. It is intended to be lightweight, but strong enough to support even a very heavy person, still without appearing to be, and certainly not being, a heavy article of furniture. Its intended function is not only to be comfortable and affordable, but also to be attractive, without the appearance of an "institutional" piece of furniture. Accordingly it is principally made of castings, extrusions which can be slim and unobtrusive, and of fabric which is suitably flexible and thin. This combination enables the chair or furniture group to be cleaned without damage.

A base 15 comprises a pair of struts 16, 17. Strut 16 has two legs 18, 19. Strut 17 has two legs 20, 21. They are mirror images of one another, so only strut 16 will be described in detail. Its rear leg 18 and forward leg 19 meet at a junction 22 that is forward of the mid-point 23 between the lower ends 24, 25 of the legs. Accordingly, the rear leg 18 makes a smaller angle with the floor than forward leg 19.

A pad 26 is attached to the bottom end of the forward leg. Preferably it is screw-mounted to the leg so it can be raised or lowered to compensate for irregularities in the floor.

The bottom end of rear leg 18 has a pad 27 mounted where it will contact the floor when the base is fully in contact with the floor. Rollers 28 are rotatably mounted to the rear legs, but are spaced from the pad so that when the pad contacts the floor, the rollers do not. When the seat is to be moved, the base is tilted around the bottom of the rear leg. This moves the rollers into contact with the floor, and moves the pad out of contact with the floor. The seat can then readily be wheeled to a new location.

A rearward first cross beam 29 rigidly interconnects the rear legs of the two struts. A forward second cross beam 30 rigidly interconnects the struts near the junctions of the legs. Cross beam 29 resists spreading of the rear legs. Cross beam 30 is more substantial for reasons which will become apparent. It must resist stronger bending and torsional forces than the cross beam 29.

The seat further includes a support 35, that receives and supports the person. It includes a bottom 36 and a back 37. Rails 38, 39 are provided at opposite sides of the back. Rails 40, 41 are provided at opposite sides of the bottom. The respective rails are strong and provide support for webs 42, 43 which the user rests on. The webs are strongly held to the rails by means of no importance to this invention.

The bottom has a gradually convex upward contour extending from its rear end to a forward lip 45. This lip is arcuate, with an approximate center of curvature 46, whose location will further be discussed below.

While the contour of the back is arbitrary, a convex lumbar portion 47 is preferably provided for comfort, and on taller seats, also a convex head rest 48. This type of back is most useful for a "patient" chair, in which an indisposed person must rest for a considerable time. A fabric web will provide a comfortable fit. Instead of a fabric web, inflexible pieces such as slats may be used, or more rigid, perhaps molded plastic shapes can be used when long-term comfort and attractiveness are of less importance.

Figure 5:
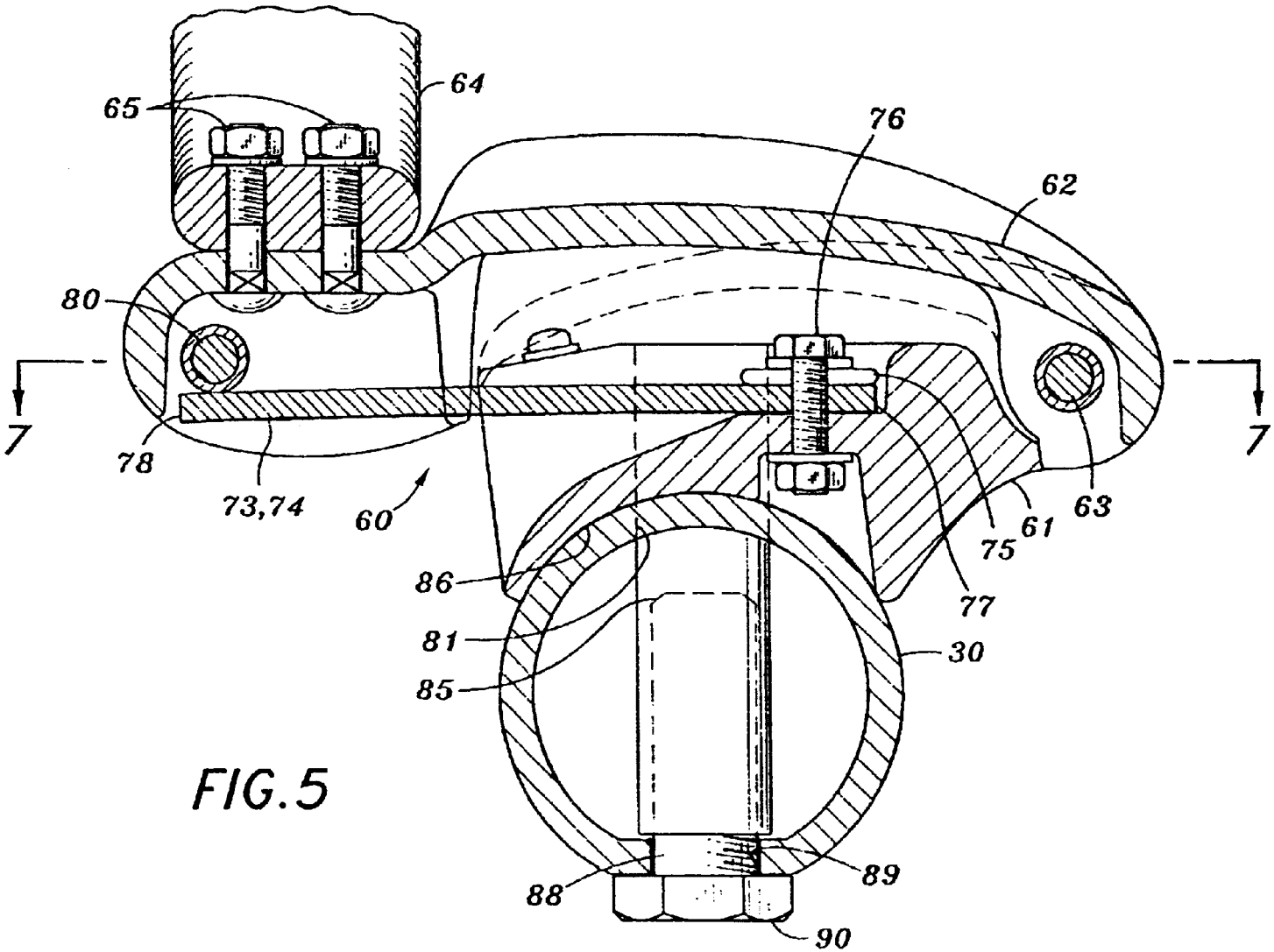
FIG. 5 is a fragmentary cross section taken at line 5—5 in FIG. 4.

A control 60 (FIG. 5) interconnects the base and the support. Its purpose is to mount the support for a knee action tilt (convexly upward) rocking motion. Its lower arm 61 (or "jaw") is bolted to forward cross beam 30. It will be observed that cross beam 30 has a very strong cross-section to resist both bending from the weight of the occupant and twisting when the occupant rocks forwardly or backwardly.

Figure 6:
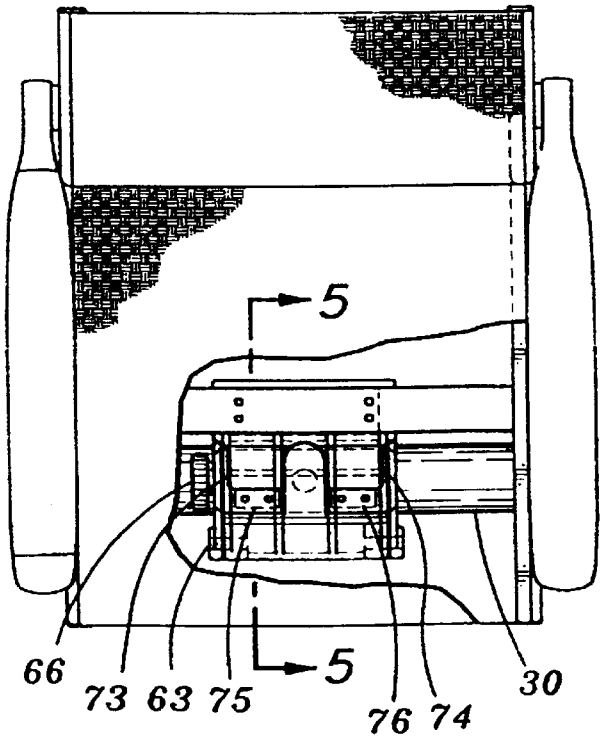
FIG. 6 is a top view, partly in cutaway cross-section showing the chair of FIG. 1.

The upper arm 62 (or "jaw") of the control is pivotally mounted to lower arm 61 by a pivot pin 63 (FIG. 6). Pin 63 is on or near the center of curvature 46 of forward lip 45 of the bottom of the support.

The upper arm of the control is bolted firmly attached to a support beam 64. The shallow U shape of beam 64 provides deflection room for a flexible seat bottom when occupied, and also provides minor side wise springiness, which will be slight, but often appreciated. The support beam at its center is bolted by bolts 65 to the upper arm so the support beam and the support rotate when the upper arm rotates. As shown, the arms 70 and 71 of the seat are pinned to the support beam.

Figure 7:
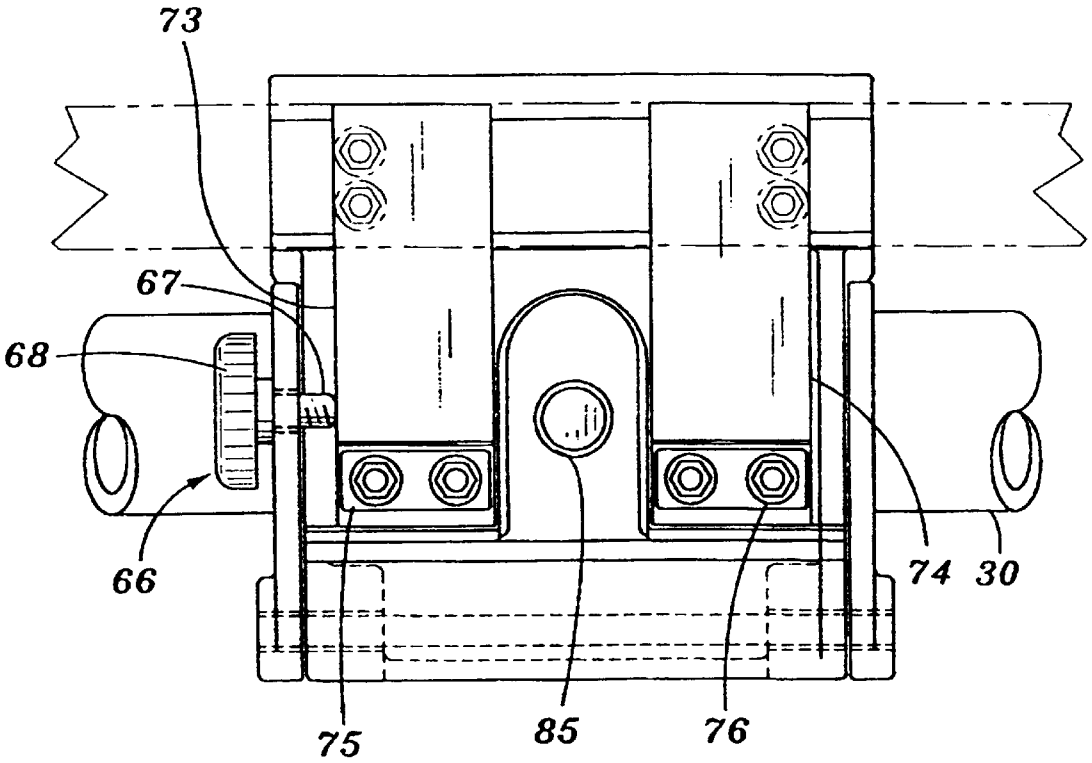
FIG. 7 is top view of the bottom part of the control.

The control could instead be a solid block if a rocking motion is not desired. Also, the control may be disabled by a lock which would prevent relative motion between the arms of the control. Such a lock 66 is shown in FIG. 7. It includes a shank 67 and a head 68. It is mounted to the upper arm and passes through it. It may be pressed in to prevent a downward movement of the upper arm by blocking it as shown. When pulled out, the rocking motion is again enabled.

The arrangement of the two pivoted arms 61 and 62 of the control allows the support to tilt. The support is held in its uppermost, forwardly tilted position by the control when there is no load on the support. It is maintained in this condition by a pair of cantilever blade-like flexures 73, 74 which are rigidly mounted to the lower arm, held between plates 75 by bolts 76. The flexures have a fixed end 77 and a free end 78. A contactor rod 80 extends across and rests on top of the flexures away from the fixed end. This rod is rigidly mounted to the upper arm at its lateral extremes and extends across the upper arm above and in contact with the flexures.

Figure 1:
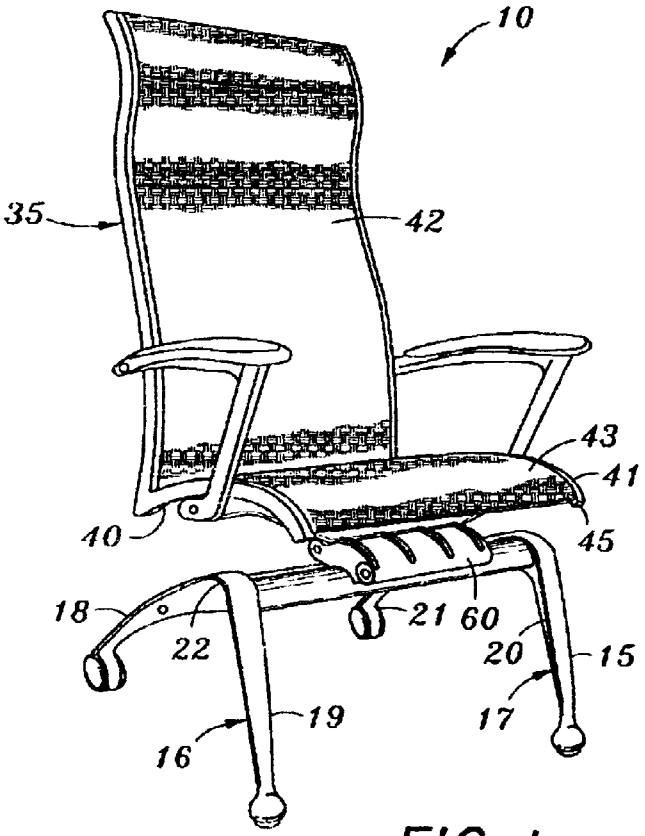
FIG. 1 is a perspective view looking toward the right front corner the preferred chair according to this invention.
Figure 4:
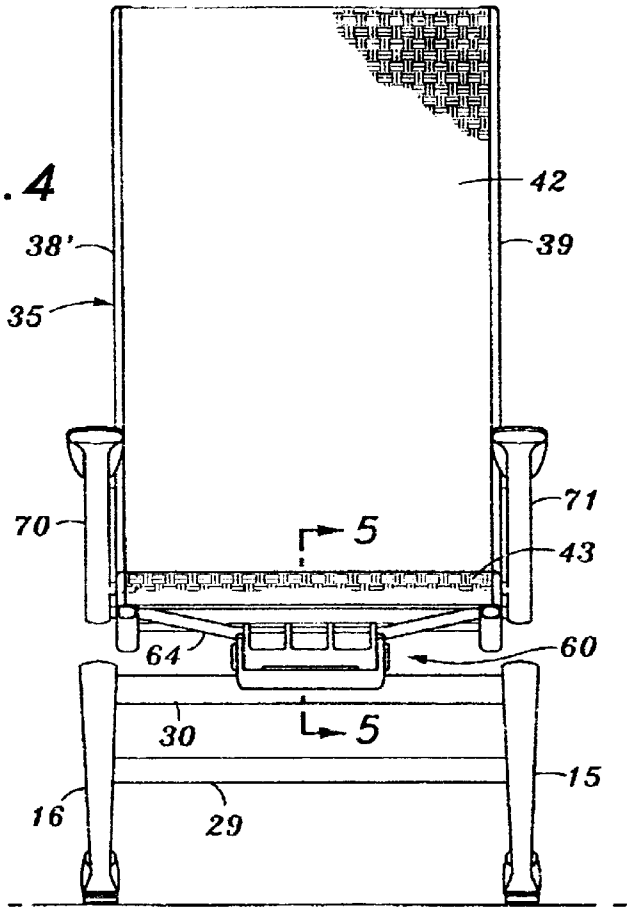
FIG. 4 is a front view of the chair in FIG. 1.
Figure 3:
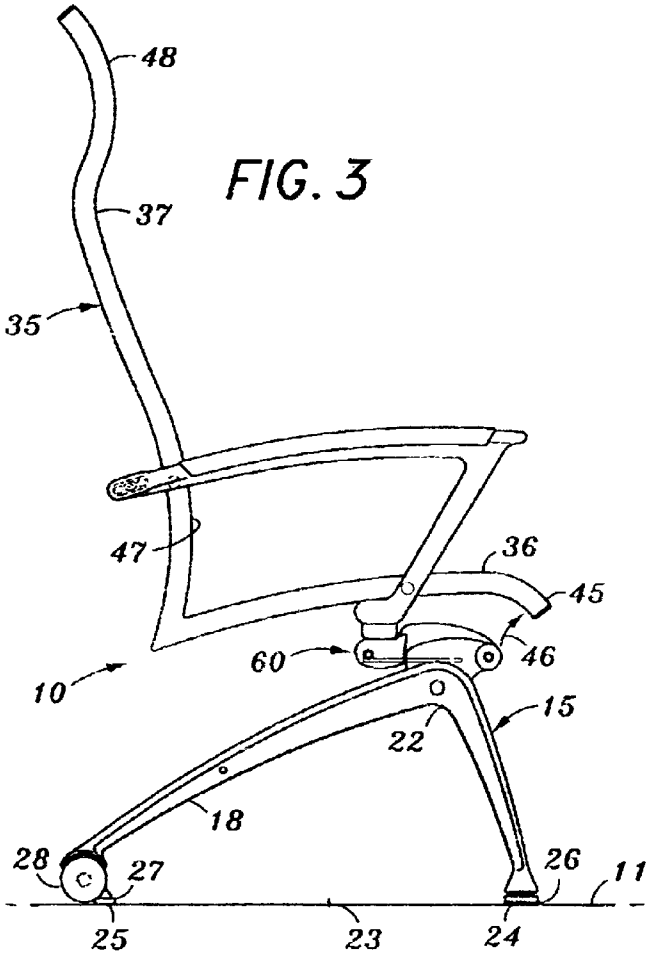
FIG. 3 is a right hand side view of the chair of FIG. 1.

A load on the support will cause the support to rotate counterclockwise in FIG. 1. Weight on the support causes the control rod to deflect the flexures, and the.flexures in turn will exert an upward resilient force tending to resist this weight. The support will assume a position respective to the force on it. The occupant can cause a rocking movement by leaning forwardly or rearwardly on the support. By selecting various thicknesses or lengths of flexures, or properties of the material of construction, the rocking characteristics can be established for a given chair.

The controls and thereby also the support are attached to beam 30 by a post 85 fixed to the bottom of the bottom arm. A curved portion 86 of the bottom arm conforms to the outside of the beam. The post passes through a hole 87 in the top of the beam, and is engaged by a bolt 88 that passes through a lower hole 89 in the beam. Head 90 on the bolt tightens the lower arm onto the beam. It will be seen that the control and support are thereby readily attached to the beam wherever there are a pair of aligned holes.

Figure 8:
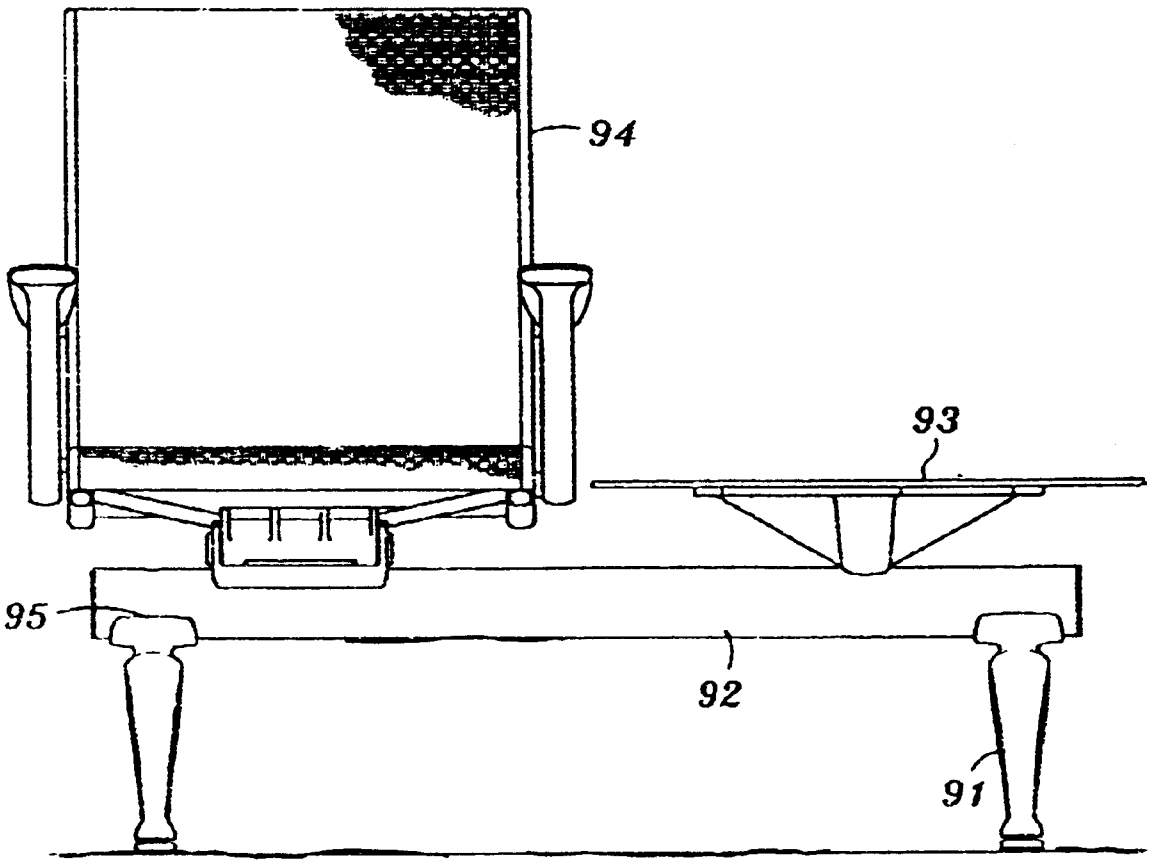
FIG. 8 is a front view of a multi-element construction.
Figure 9:
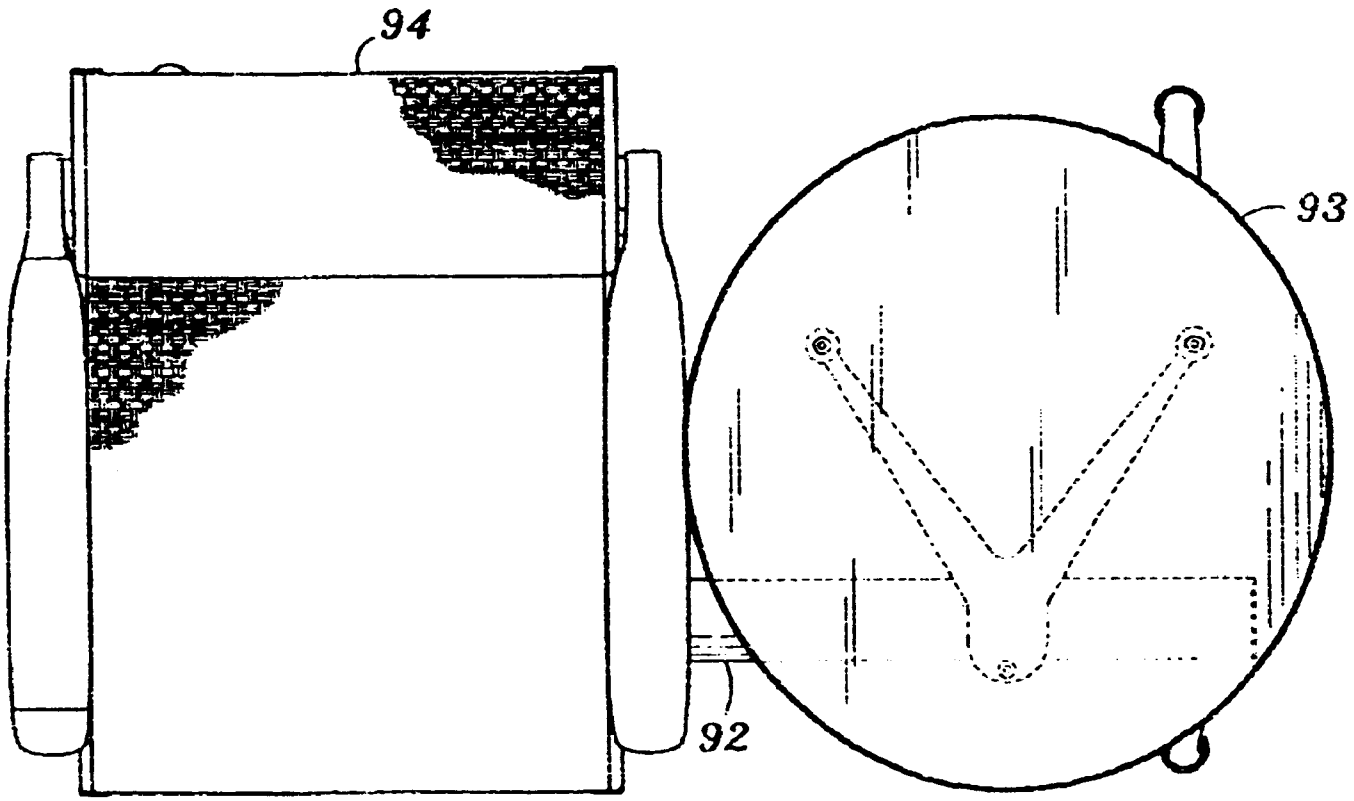
FIG. 9 is a top view of FIG. 8.

The versatility of this arrangement is shown in FIGS. 8 and 9. Here, one of the struts 91 is moved toward the end of an elongated beam 92 (similar in function to beam 30), and a table 93 (or other chair is mounted to the beam by means similar to that used for the control. Seat 94 is thereby spaced from the table. In this arrangement it may be preferred to provide saddles 95 on the struts, instead of bolting through them from the sides as shown in FIG. 1.

Also, the shape of the cross beam is variable, and need not be circularly tubular. The shapes may be adapted to provide best appearance.

The illustrated example is for a single patient chair. Its contours are selected to provide long term comfort for the occupant, and can be placed in any suitable location.

The web which forms the back and seat areas on which the user rests can be made of any desired material. Preferably it will be a woven open mesh material which is flexible and stiffly conformable. Its material should be resistant to water and to common sanitizing solutions so the chair can be cleaned readily and without damage.

The flexure can be made of any material which is springly bendable. Composite fabric reinforced plastic bars are suitable. Instead, metal flexures may be used, as desired.

This invention provides a light weight, attractive and safe support for persons alone or in groups. Modification of the control allows for more or less tilting, and even for no tilting at all.

This invention is not limited by the embodiments shown in the drawings and described in the description, which are given by way of example and not of limitation, but only in accordance with the scope of the appended claims

What is claimed is:

1. A seat facing forwardly to receive an occupant comprising:

a base comprising a pair of rigid spaced-apart struts, each strut having a front leg and a rear leg, said legs meeting at a junction located forwardly of a mid-point between their lower ends, a rigid cross-beam joined to said struts at said junctions, said rear legs proportioned to remain firmly on the floor;

a support comprising a bottom and a back, said support including a pair of spaced-apart rigid side rails and a woven web supported by and extending between said side rails, said bottom extending forwardly from said back, and at its forward end including a downwardly-turned arcuate edge having a radius of curvature;

a control comprising a lower arm rigidly attached to said cross-beam, an upper arm on which said support is rigidly mounted, and a pivot rotatably joining said arms near the center of curvature of said arcuate edge forwardly of said mid-point and lower than a knee of an occupant, said arms extending rearwardly from said pivot, whereby an occupant can rock said support while his feet remain on the floor, a rearwardly extending stiffly flexible flexure fixed to said lower arm and extending rearwardly in a cantilever manner toward an unsupported free end between said arms, and a contactor extending across and above said flexure carried by said upper arm so disposed and arranged as to contact the said flexure at a spacing from its attachment to said lower arm so that the flexure will bias the support toward an upper position, weight of an occupant tending to rock the support rearwardly against said bias;

said base and said support being made of material resistant to wet cleaning and sanitizing; and a releasable lock interposed between said arms adapted to permit or to prevent movement of the upper arm toward the lower arm so as to prevent or to permit rocking movement of the support.

2. A seat according to claim 1 in which a support beam interconnects said upper arm and said support, shaped as a gentle "U" to accommodate deflection of the bottom when loaded.

3. A seat according to claim 1 in which a pad and a wheel are fixed to each of said rear legs, said wheels being so disposed and arranged as to be out of contact with a floor when the pad is in contact with the floor, and in contact with the floor when the seat is tilted to move the pads up from the floor.

4. A seat according to claim 1 in which said cross-beam is extended past one of said struts, and an article of furniture is attached to it so as to form a unitary structure comprising the seat and the additional article.

* * * * *